US007018010B2

(12) United States Patent
Kobayashi et al.

(10) Patent No.: US 7,018,010 B2
(45) Date of Patent: Mar. 28, 2006

(54) LINE SCANNING TYPE INK JET RECORDING DEVICE CAPABLE OF FINELY AND INDIVIDUALLY CONTROLLING INK EJECTION FROM EACH NOZZLE

(75) Inventors: Shinya Kobayashi, Hitachinaka (JP); Takahiro Yamada, Hitachinaka (JP); Kazuo Shimizu, Hitachinaka (JP); Kunio Satou, Hitachinaka (JP); Hitoshi Kida, Hitachinaka (JP)

(73) Assignee: Ricoh Printing Systems, LTD, Tokyo (JP)

( * ) Notice: Subject to any disclaimer, the term of this patent is extended or adjusted under 35 U.S.C. 154(b) by 75 days.

(21) Appl. No.: 09/805,216

(22) Filed: Mar. 14, 2001

(65) Prior Publication Data

US 2001/0038397 A1 Nov. 8, 2001

(30) Foreign Application Priority Data

Mar. 17, 2000 (JP) ..... 2000-075116

(51) Int. Cl.
*B41J 29/393* (2006.01)

(52) U.S. Cl. ..... 347/19; 347/9; 347/14

(58) Field of Classification Search ..... 347/9, 347/14, 16, 40, 77, 82, 106, 135, 10, 19; 358/1, 9

See application file for complete search history.

(56) References Cited

U.S. PATENT DOCUMENTS 4,673,951 A * 6/1987 Mutoh et al. ..... 346/75
5,438,437 A * 8/1995 Mizoguchi et al. ..... 358/518
5,689,291 A * 11/1997 Tence et al. ..... 347/10
5,807,437 A * 9/1998 Sachs et al. ..... 118/688
6,025,929 A * 2/2000 Nakajima et al. ..... 358/1.9
6,046,822 A * 4/2000 Wen et al. ..... 358/1.9
6,471,352 B1 * 10/2002 Akahira ..... 347/106
6,607,260 B1 * 8/2003 Ikeda ..... 347/19

FOREIGN PATENT DOCUMENTS

| | | | |
|---|---|---|---|
| EP | 0 931 663 | A2 | 7/1999 |
| EP | 1023999 | A2 * | 8/2000 |
| JP | 02-235758 | A | 9/1990 |
| JP | 11-058721 | A | 3/1999 |
| JP | 11-058733 | A | 3/1999 |
| JP | 11-078013 | | 3/1999 |
| JP | 02001228320 | A * | 8/2001 |

* cited by examiner

*Primary Examiner*—Hai Pham
*Assistant Examiner*—Lam S. Nguyen
(74) *Attorney, Agent, or Firm*—Whitham, Curtis & Christofferson P.C.

(57) ABSTRACT

A computer portion 201 of a printer includes a memory storing a printer driver software 201*a* and nozzle profile data 211. The printer driver software 201*a* includes a raster image processor (RIP) 203. When the RIP 203 receives document data 209, the RIP 203 converts the document data 209 into bitmap data 210 which is one dot/one bit data for 300 data/inch. Then, the nozzle data converting portion 204 converts the bitmap data 210 into driving data 212 based on the nozzle profile data 211. At this time, each bit of the bitmap data 210 is replaced by 16 bits. That is, the data amount is increased to 16 times of the bitmap data 210. Accordingly, fine control of ink ejection can be achieved.

8 Claims, 11 Drawing Sheets

211

| NOZZLE NO. | COORDINATE VALUE | | PULSE DATA 1 | PULSE DATA 2 | -------- | PULSE DATA N |
|---|---|---|---|---|---|---|
| | x | y | | | | |
| 1 | | | | | | |
| 2 | | | | | | |
| 3 | | | | | | |
| ⋮ | | | | | | |
| 5,120 | | | | | | |

FIG.17

| NOZZLE NO. | COORDINATE VALUE | | PULSE DATA 1 | PULSE DATA 2 | -------- | PULSE DATA n |
|---|---|---|---|---|---|---|
| | x | y | | | | |
| | | | | | | |
| n1 | | | 07e0 | | | |
| n2 | | | 03e0 | | | |
| n3 | | | 03c0 | | | |
| | | | | | | |
| | | | | | | |

FIG.18

| NOZZLE NO. | COORDINATE VALUE | | PULSE DATA 1 | PULSE DATA 2 | -------- | PULSE DATA n |
|---|---|---|---|---|---|---|
| | x | y | | | | |
| | | | | | | |
| n1 | | | 03c0 | | | |
| n2 | | | 0340 | | | |
| n3 | | | 02c0 | | | |
| | | | | | | |
| | | | | | | |

LINE SCANNING TYPE INK JET RECORDING DEVICE CAPABLE OF FINELY AND INDIVIDUALLY CONTROLLING INK EJECTION FROM EACH NOZZLE

BACKGROUND OF THE INVENTION

1. Field of the Invention

The present invention relates to a dot-on-demand type ink jet printer including piezoelectric elements capable of reliably printing high quality images at high speed.

2. Related Art

There has been proposed a dot-on-demand type image forming device. Although the dot-on-demand type image forming device is relatively slow in printing speed compared with a continuous type image forming device, the dot-on-demand type image forming device has a simple configuration, so has become more popular.

Japanese Patent Application Publication (Kokai) No. HEI-11-78013 discloses a dot-on-demand line-scanning type ink jet recording device including a print head. The print head has a width corresponding to an entire width of a recording sheet, and is formed with a plurality of nozzles arranged in a line. Each nozzle is provided with an ejection element, such as a piezoelectric element or thermal element. The ejection elements are selectively driven based on a print signal while the recording sheet is being transported in a sheet feed direction at a high speed. As a result, ink droplets are ejected from the nozzles and hit on corresponding scanning lines of the recording sheet. In this way, ink images are formed on the recording sheet.

In this type of image forming device, because each nozzle of the print head corresponds to each one of scanning lines on the recording sheet, a large number of nozzles are necessary. For example, in order to form an image on a recording sheet having an 18-inch width at a resolution of 300 dot/inch (dpi), 5,400 (300 dpi×18 inch) nozzles need to be formed to the print head. In order to form the image with four different colors, 21,600 (5,400 nozzles×4 colors) nozzles are necessary.

However, it is difficult and expensive to produce an accurate print head with such a large number of nozzles without causing unevenness among the nozzles. Uneven nozzles undesirably degrade printing quality. Moreover, even if a precise print head is produced, unevenness may occur among the nozzles over time of use.

Specifically, unevenness among nozzles will cause the following problems. FIG. 1 is a top view showing a print head 207 and a recording sheet 406. The print head 207 is fixed at a predetermined position and ejects ink against the recording sheet 406 while the recording sheet 406 is being transported in a direction indicated by an arrow y with respect to the print head 207. In FIG. 1, dot regions on the recording sheet 406 are indicated by broken lines. Because the printer is designed for 300 dpi resolution in the x direction, each dot region has a width of 85 μm in the x direction. The print head 207 has formed dots 401 through 405 in every other dot regions on the recording sheet 406. The dot 401 is formed in a suitable manner. However, the dots 402 through 405 are formed at in an undesirable manner.

That is, the dot 402 is formed slightly above the target dot region. One possible explanation for this is that an ink droplet corresponding to the dot 402 is ejected from the print head 207 at an ejection speed higher than a proper ejection speed. Details will be described while referring to FIG. 2.

As described above, the recording sheet 406 is being transported in the y direction with respect to the print head 207 when the ink droplet is ejected. Therefore, although the ink droplet is ejected at the time when a position YO of the recording sheet 406 is located directly beneath a corresponding nozzle of the print head 207, an actual location where the ejected ink droplet impacts is a position Y which is different from the ejection position YO. The impact position Y is determined in a following equation:

$$Y=YO-D\times Vp/Vd \quad \text{(E1)}$$

wherein Y is the position where the ink droplet impacts;

Y0 is the position which is located directly beneath the corresponding nozzle when the ink droplet is ejected from the nozzle;

D is a distance between the nozzle and the recording sheet 406;

Vp is a transporting speed of the recording sheet 406 in the y direction; and Vd is an average ejection speed of the ink droplet.

That is, when the ejection speed Vd is higher than a desired ejection speed, then a dot is recorded above a desired impact position in FIG. 1. On the other hand, when the ejection speed Vd is slower than the desired ejection speed, then a dot is recorded below the target impact position.

FIG. 1, the dot 403 has a smaller diameter than the dot 401. Such a dot is formed when an ink amount of a corresponding ink droplet is insufficient. The dot 404 has an elongate shape in the Y direction. When an ink droplet being ejected has a higher ejection speed at its leading portion than the ejection speed at its tailing portion, then the ink droplet impacts onto the recording sheet 406 while having an elongate shape rather than a circular shape. This results in forming a dot having an unusual dot shape, such as the dot 404. The dot 405 is called satellite dot which has a larger dot and a smaller dot formed below and separated from the larger dot. The satellite dot is formed when speed difference between a leading portion and a tailing portion of an ejected ink droplet is greater than that of the dot 404. That is, an ink droplet being ejected is divided into two or more droplets before the ink droplet impacts on the recording sheet 406 because of the speed difference. When recorded dots include these unusual dots, quality of images will be undesirably degraded. Such problems occur in any type of on-demand ink jet printer regardless of which type of ink or nozzles are used.

SUMMARY OF THE INVENTION

In order to prevent these problems, it is conceivable to control the ejection speed Vd. As indicated by the above equation E1, when the ejection speed Vd changes, the impact position in the y direction of an ink droplet also changes. Therefore, by controlling the ejection speed Vd individually for each nozzle, ink droplets will impact within target regions. The ejection speed Vd is controlled by changing the voltage and duration of the driving pulse for driving the ejection element.

The above resolution is effective for a print head having a relatively small number of nozzles where a relationship between the ejection speed Vd and the ejection amount m is fixed. That is, when the ejection speed Vd is adjusted to a proper speed, then the ejection amount m of the ink droplet is automatically adjusted to a proper amount.

However, the solution is not effective for a print head having a relatively large number of nozzles, such as the print head disclosed in Japanese Patent Application Publication (Kokai) No. HEI-11-78013. Details will be described while referring to a graph F1 shown in FIG. 3. The graph F1 shows the usual relationships between a driving voltage (V) of a driving pulse and an ejection speed Vd (m/s) and between the driving voltage (V) and an ink ejection amount m (ng) of an ink droplet. It should be noted that the driving voltage has a rectangular shape. When a large number of nozzles are provided to a print head, the ink ejection amount m may greatly differ among the nozzles even if ejection speed characteristics are the same. For example, as indicated in the graph F1, a nozzle N1 and a nozzle N2 have the same ejection speed characteristics in relation to the driving voltage (V). However, the nozzles N1 and N2 have a different ink ejection amount characteristic in relation to the driving voltage (V). Accordingly, when a proper ejection speed Vd is achieved for the nozzles N1 and N2, the ink ejection amount m will greatly differ between the nozzles N1 and N2. On the other hand, when a proper ink ejection amount m is achieved for both the nozzles N1 and N2, then the ejection speed Vd will differ between the nozzles N1 and N2. Accordingly, a proper ejection speed Vd and a proper ink ejection amount cannot be achieved at the same time.

It is an objective of the present invention to overcome the above problems, and to provide a line scanning type image forming device including an on-demand type ink jet print head capable of reliably forming high quality images at high speed.

BRIEF DESCRIPTION OF THE DRAWINGS

In the drawings:

FIG. 12(*b*) shows a driving pulse divided by Tsplit;

FIG. 17 is an explanatory diagram showing an example of updated nozzle profile data;

FIG. 18 is an explanatory diagram showing an example of updated nozzle profile data;

PREFERRED EMBODIMENTS OF THE PRESENT INVENTION

Printers according to embodiments of the present invention will be described next.

First, an overall configuration of a printer according to a first embodiment of the present invention will be described while referring to FIGS. 4, 5, and 8.

Figure 4:
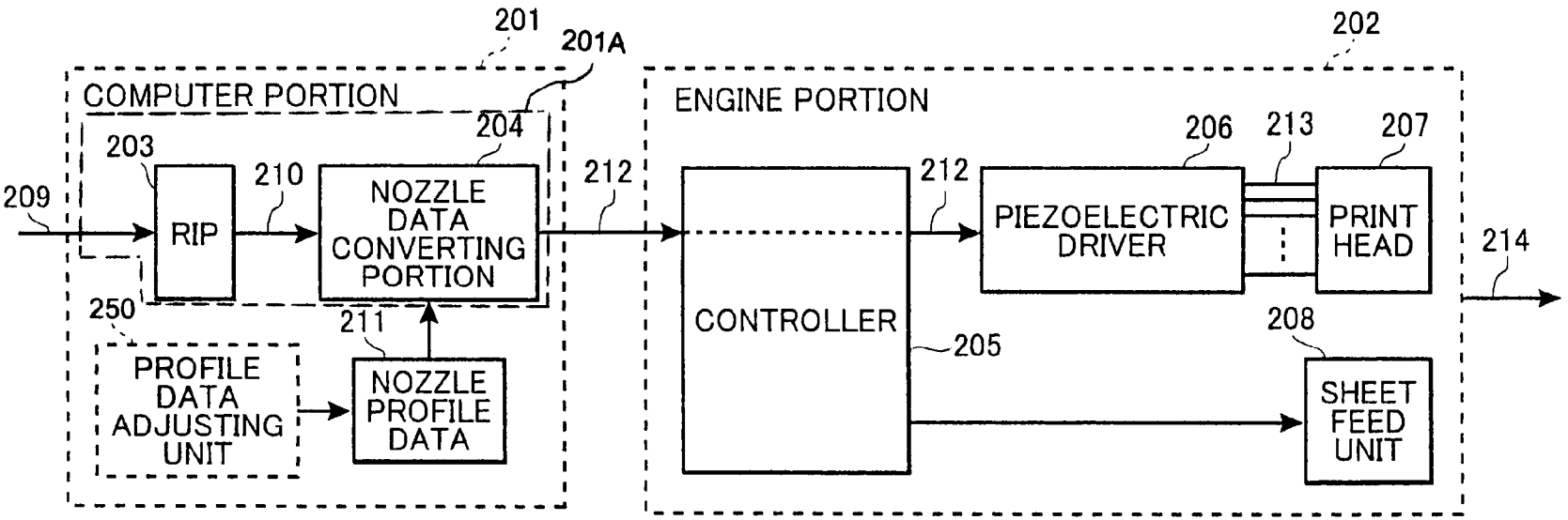
FIG. 4 is a block diagram showing the printer system according to the embodiment of the present invention.

As shown in FIG. 4, the printer includes a computer portion 201 and an engine portion 202. The computer portion 201 includes a memory storing a printer driver software 201*a* and nozzle profile data 211. The printer driver software 201*a* includes a raster image processor (RIP) 203 and a nozzle data converting portion 204. The engine portion 202 includes a controller 205, a piezoelectric driver 206, a print head 207, and a sheet feed unit 208.

Figure 8:
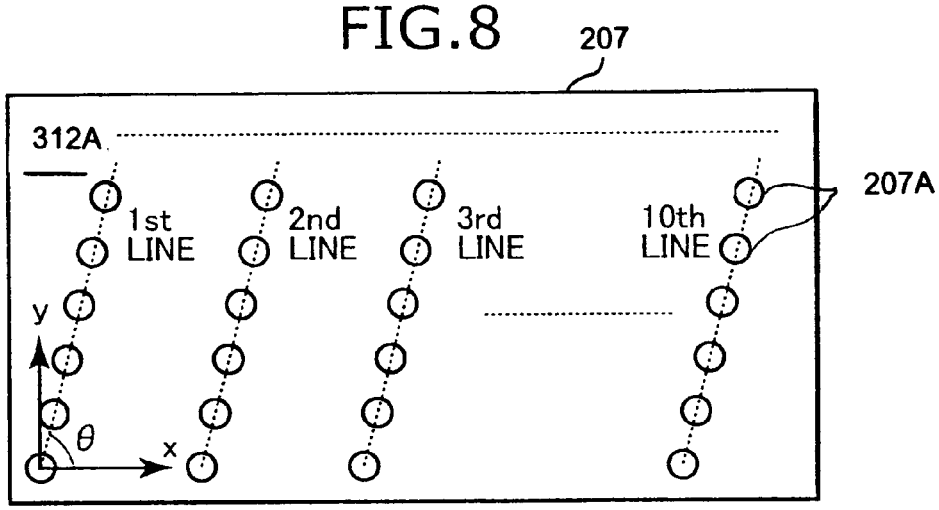
FIG. 8 is a plan view showing a nozzle surface of the print head.

FIG. 8 shows an ink ejection surface 312*a* of the print head 207. The print head 207 is formed with a plurality of nozzles 207*a*. A center position of each nozzle 207*a* is expressed by the x and y coordinate axis in a unit of length (μm). It should be also noted that a recording sheet is transported in the y direction in the present embodiment.

The engine portion 202 is designed for printing at 300 dot/inch (dpi) in both the x and y coordinate axis. Because a nozzle pitch of adjacent nozzles 207*a* is formed greater than 300 dpi, as shown in FIG. 8 the ink ejection surface 312*a* of the print head 207 is formed with ten nozzle lines inclined by an angle θ of approximately 82.8 degrees with respect to the x coordinate axis. In other words, the print head 207 includes ten small print heads aligned in the x direction. Each nozzle line, that is, each small print head, has 512 nozzles aligned at a nozzle pitch of 32.5 dpi. Accordingly, a total of 5,120 nozzles are formed in the print head 207, and a nozzle pitch in the x direction is 300 dpi. A print width in the x direction is approximately 17 inches.

A color printer includes a plurality of, four for example, print heads 207. However, in order to simplify explanation, the present embodiment will be described for a monochromatic printer including only one print head 207. Needless to say, the present invention can be applied to the color printer.

Figure 5:
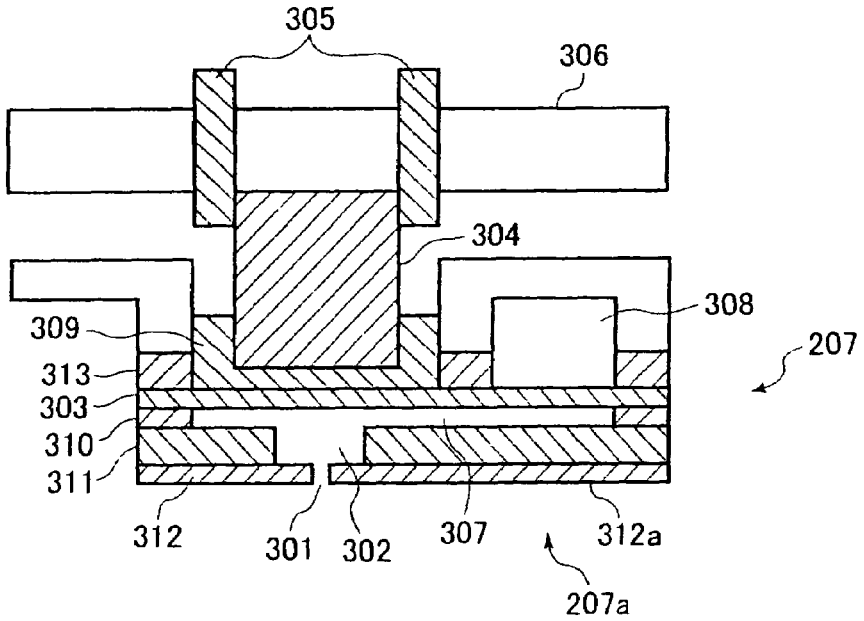
FIG. 5 is a cross-sectional view of a print head of the printer system.

FIG. 5 shows configuration of the nozzles 207*a* of the print head 207. As shown in FIG. 5, the print head 207 includes an diaphragm 303, a piezoelectric element 304, a signal input terminal 305, a piezoelectric element supporting substrate 306, a restrictor plate 310, a pressure-chamber plate 311, an orifice plate 312, and a supporting plate 313, together defining a nozzle 207*a*. The diaphragm 303 and the piezoelectric element 304 are attached to each other by a resilient member 309, such as a silicon adhesive. The restrictor plate 310 defines a restrictor 307. The pressure-chamber plate 311 and the orifice plate 312 define a pressure chamber 302 and an orifice 301, respectively. A common ink supply path 308 is formed above the pressure chamber 302 and is fluidly connected to the pressure chamber 302 via the restrictor 307. Ink flows from above to below through the common ink supply channel 308, the restrictor 307, the pressure chamber 302, and orifice 301. The restrictor 307 regulates an ink amount supplied into the pressure chamber 302. The supporting plate 313 supports the diaphragm 303. The piezoelectric element 304 deforms when a voltage is applied to the signal input terminal 305, and maintains its initial shape when a voltage is not applied.

The diaphragm, the restrictor plate 310, the pressure-chamber plate 311, and the supporting plate 313 are formed from stainless steel, for example. The orifice plate 312 is formed from nickel material. The piezoelectric element supporting substrate 306 is formed from an insulating material, such as ceramics and polyimide.

Next, operations performed during printing will be described while referring to FIGS. 4, 7, 9, and 10.

Figure 10:
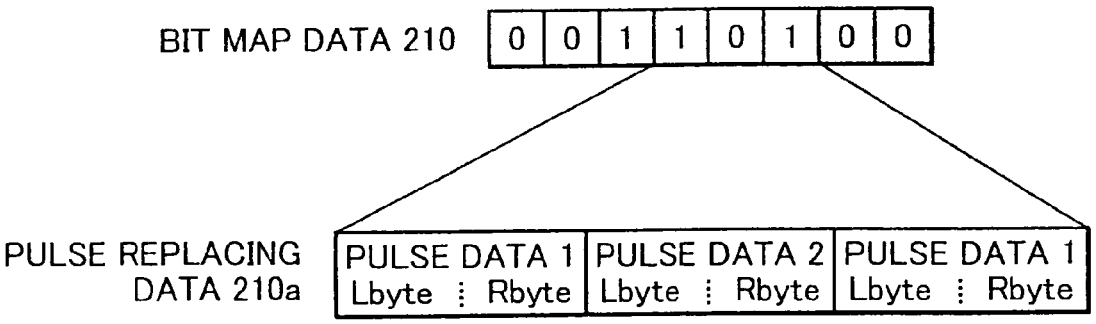
FIG. 10 is an explanatory view showing a method of converting bitmap data into pulse replacing data.

In FIG. 4, when the RIP 203 receives document data 209, the RIP 203 converts the document data 209 into bitmap data 210, which has a resolution in accordance with specifications of the engine portion 202. In the present embodiment, the bitmap data 210 is one dot/one bit data for 300 dpi. An example of the bitmap data 210 is shown in FIG. 10. As shown in FIG. 10, each bit of the bitmap data 210 takes a value of either "1" or "0", where "1" represents a colored dot and "0" represents uncolored dot. Then, the bitmap data 210 is input to the nozzle data converting portion 204. The nozzle data converting portion 204 converts the bitmap data 210 into pulse replacing data 210*a* (FIG. 10) and further into driving data 212 based on the nozzle profile data 211, which is prestored in the computer portion 201.

Figures 6, 7:
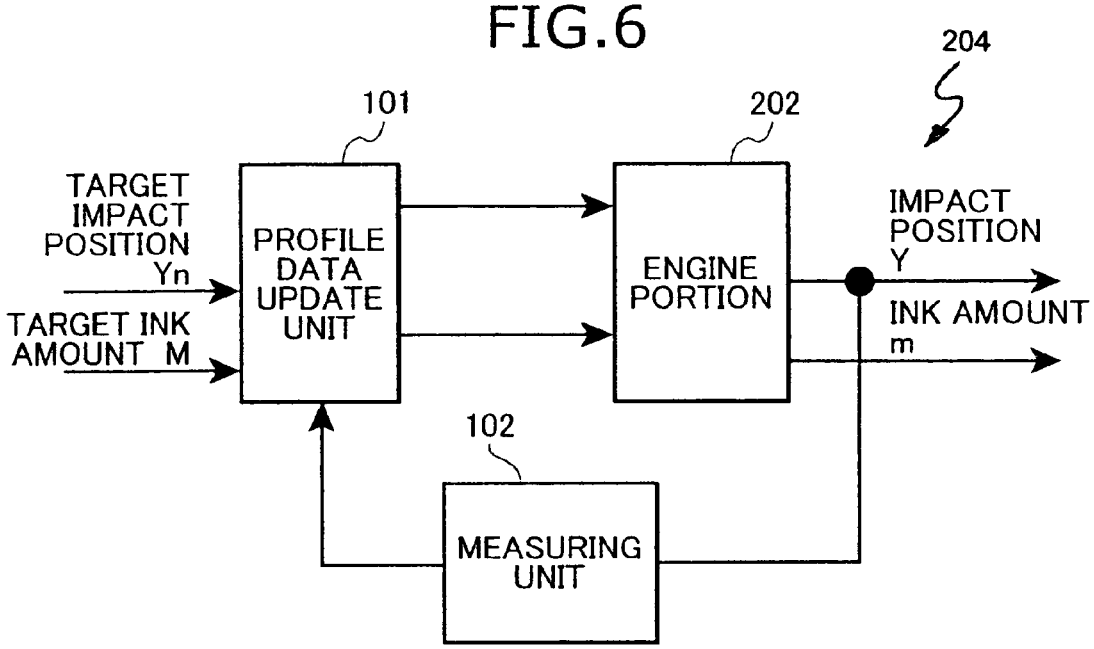
FIG. 6 is an explanatory block diagram showing a control method of a nozzle data converting portion of a printer system according to an embodiment of the present invention.
FIG. 7 is an explanatory view showing configuration of nozzle profile data.

As shown in FIG. 7, the nozzle profile data 211 has a simple table configuration including a plurality of columns. In the first column, nozzle numbers are listed. Because 5,120 nozzles 207*a* are formed to the print head 207 of the present embodiment, the nozzles are numbered 1 through 5,120. The second column lists coordinates of the corresponding nozzles 207*a* shown in FIG. 8, and includes an x column and a y column. In the x column, x coordinate values (μm) are listed. The x coordinate values are referred to only for arranging the nozzles 207*a* in an order from the one having the smallest x coordinate value to the one having the greatest. In the y column, y coordinate values (μm) of the corresponding nozzles 207*a* are listed. As will be described later in more details, a generating timing for generating a driving pulse of the driving data 212 is determined based on the y coordinate values. Although the y coordinate values initially indicate the positions of the corresponding nozzles 207*a* shown in FIG. 8, the y coordinate values are updated when the generating timings are changed. That is, these values in the y column can be defined as an indicator of the driving pulse generating timing. However, these values will be simply referred to as the y coordinate values in the present embodiment.

In third and fourth columns, pulse data 1 and 2 of the corresponding nozzles 207*a* are listed, respectively. A voltage waveform of the above-mentioned driving pulse is determined by the pulse data 1 and 2. It should be noted that the magnitude of the driving voltage is maintained constant.

The pulse data 1 of the nozzle profile data 211 is used for ink ejection, that is, when the bitmap data 210 has a value of "1" for colored dot. On the other hand, the pulse data 2 is used for ink nonejection, that is, when the bitmap data 210 has a value of "0" for uncolored dot. The pulse data 2 is called dummy pulse data and generated for regulating interference between the nozzles 207*a*. In the present embodiment, pulse data other than the pulse data 1 and 2 is not used. However, when a sensor (not shown) detects that printing condition is changed because of, for example, change in recording sheet material, printing speed, nozzle temperature, and kind of ink to be used, then the pulse data 1 can be replaced by any other suitable pulse data included in the nozzle profile data 211, so that a voltage waveform optimal for printing images with maximum possible quality can be formed in accordance with the printing condition.

Figure 9:
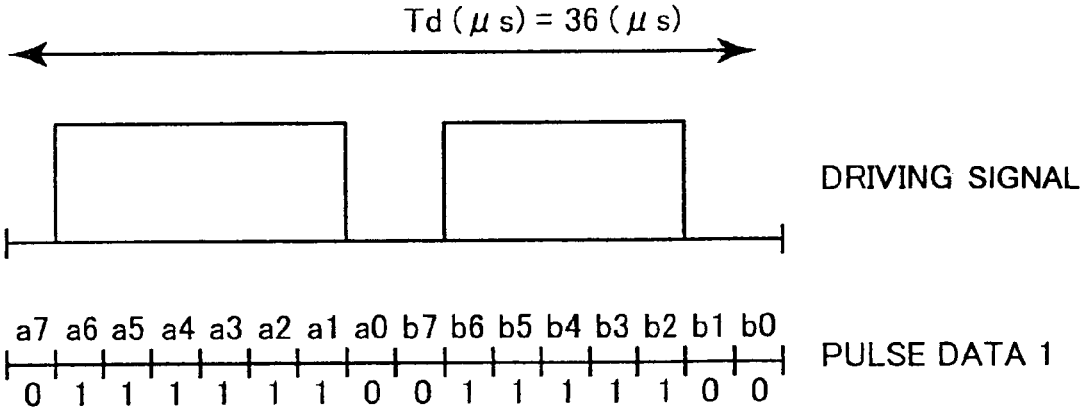
FIG. 9 is an explanatory view of a configuration of pulse data.

FIG. 9 shows configuration of the pulse data 1 (2). The pulse data 1 (2) is two-byte data including Lbyte (a7, a6, . . . a0) and Rbyte (b7, b6, . . . b0), where a7 and b7 represent MSB, and a0 and b0 represent LSB. Each bit takes a value of either "1" or "0". In the example shown in FIG. 9, the 16 bits of the pulse data 1 (2) has the values of "0111111001111100". These values are represented in the hexadecimal number system and differ among the nozzles. Examples will be found in FIGS. 17 and 18. The value "1" indicates voltage application to the piezoelectric element 304, and the value "0" indicates voltage nonapplication to the piezoelectric element 304. A time duration required for recording a single dot, that is, the time width of the driving data 212 for a single dot, is Td (36 μs in the present embodiment). Accordingly, each of the bits a7 through b0 of the pulse data 1 (2) has a time width of 1/16 Td(μs).

As shown in FIG. 10, the nozzle data converting portion 204 converts the bitmap data 210 into the pulse replacing data 210*a* using the pulse data 1 and 2 of the nozzle profile data 211. Specifically, the bitmap data 210 having the value "1" is replaced by the pulse data 1, and the bitmap data 210 having the value "0" is replaced by the pulse data 2. Because each bit of the bitmap data 210 is replaced by 16 bits (a7 through b0), the pulse replacing data 210*a* has 4800 data/inch (300 data/inch×16). That is, the data amount is increased to 16 times the amount of the bitmap data 210.

Then, the nozzle data converting portion 204 converts the pulse replacing data 210*a* into the driving data 212 for each nozzle 207*a* based on the corresponding y coordinate value of the nozzle profile data 211. Specifically, the pulse replacing data 210*a* of each nozzle 207*a* is shifted in the y direction by the corresponding y coordinate value, thereby producing the driving data 212. Because the data amount of the pulse replacing data 210*a* in the y direction is as high as 4800 data/inch, the pulse replacing data 210*a* is converted into the driving data 212 in a precise manner. Accordingly, the driving pulse of the driving data 212 can be generated at a precise timing for each nozzle 207*a*.

The driving data 212 generated in this manner may be temporarily stored in a memory (not shown) provided to the computer portion 201. Then, printing may be executed when a plurality of pages worth of driving data 212 is stored in the memory. However, in the present embodiment, the printing is executed every time when one page worth of driving data 212 is generated.

When nozzle data converting portion 204 has generated the driving data 212, then the controller 205 controls the sheet feed unit 208 to feed a recording sheet. When a print start position of the recording sheet is detected, then the controller 205 transmits the driving data 212 from the computer portion 201 to the piezoelectric element driver 206. The piezoelectric element driver 206 generates a driving signal 213 with a relatively high voltage value based on the driving data 212. The driving signal 213 is then input to the signal input terminal 305 of the corresponding piezoelectric element 304 provided to the print head.

At this time, parallel-serial conversion and serial-parallel conversion are performed. That is, because a relatively large number of nozzles 207*a* are provided to the print head 207, a large number of signal lines are required between the computer portion 201 and the piezoelectric driver 206. However, these conversions reduce the number of signal lines. Because these conversions are well-known techniques, detailed explanation is omitted here.

When the signal input terminal 305 receives the driving signal 213, then the piezoelectric element 304 selectively deforms based on the driving signal 213. Accordingly, an ink droplet is ejected from the nozzle 207*a*, so an image 214 is formed on the recording sheet.

Because the print head 207 of the present embodiment includes a plurality of small print heads as described above, and has a relatively long width in the x direction, difference in nozzle characteristics is significant. Accordingly, the relationship between the ejection speed Vd and the ink ejection amount m differs among these nozzles 207*a*. As a result, undesirable dots, such as the dot 404 and the dot 405, may be formed.

In order to overcome the above-described problems, the printer system of the present invention performs the ink ejection control so that an impact position Y of an ink droplet and an ink ejection amount m are adjusted at the same time for each nozzle 207*a* in addition to adjustment of the ink ejection speed Vd.

Specifically, as shown in FIG. 6, the nozzle data converting portion 204 includes a profile data update unit 101 and a measuring unit 102. The measuring unit 102 includes a CCD camera or the like (not shown). The profile data update unit 101 executes an updating process for updating the y coordinate values and pulse data 1 of the nozzle profile data 211 based on a command indicating a target impact position Yn and a target ink ejection amount M. The updating process includes a first stage and a second stage. At the first stage, an ink ejection amount m of each nozzle 207*a* is adjusted. At the second stage, an impact position Y of an ink droplet on a recording sheet is adjusted. First, detailed description for the first stage will be provided below.

Figure 1:
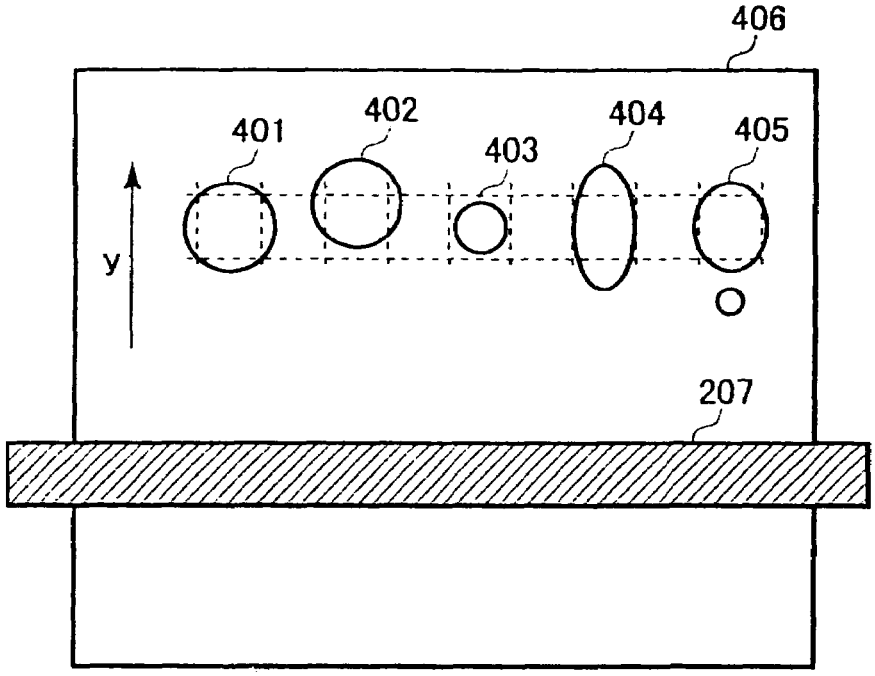
FIG. 1 PRIOR ART
FIG. 1 is a top view showing a recording sheet formed with dots.
Figure 2:
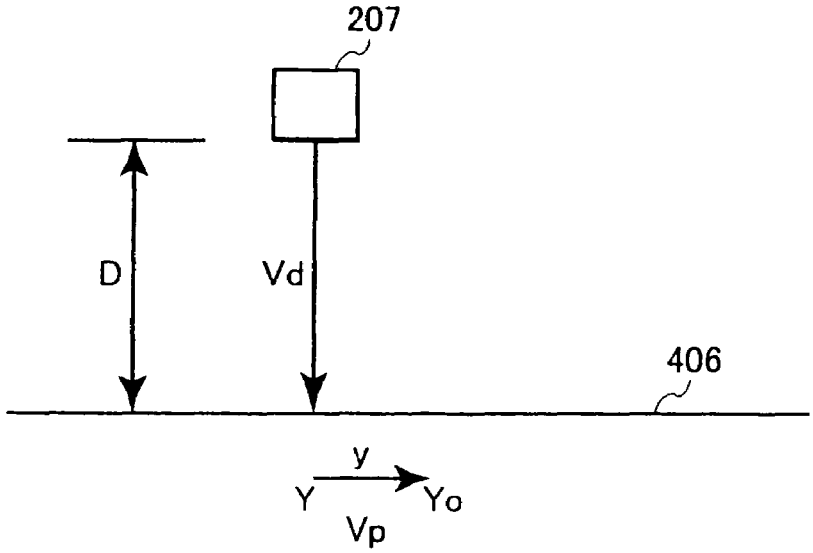
FIG. 2 PRIOR ART
FIG. 2 is a side view showing a positional relationship between the print head and the recording sheet.
Figure 3:
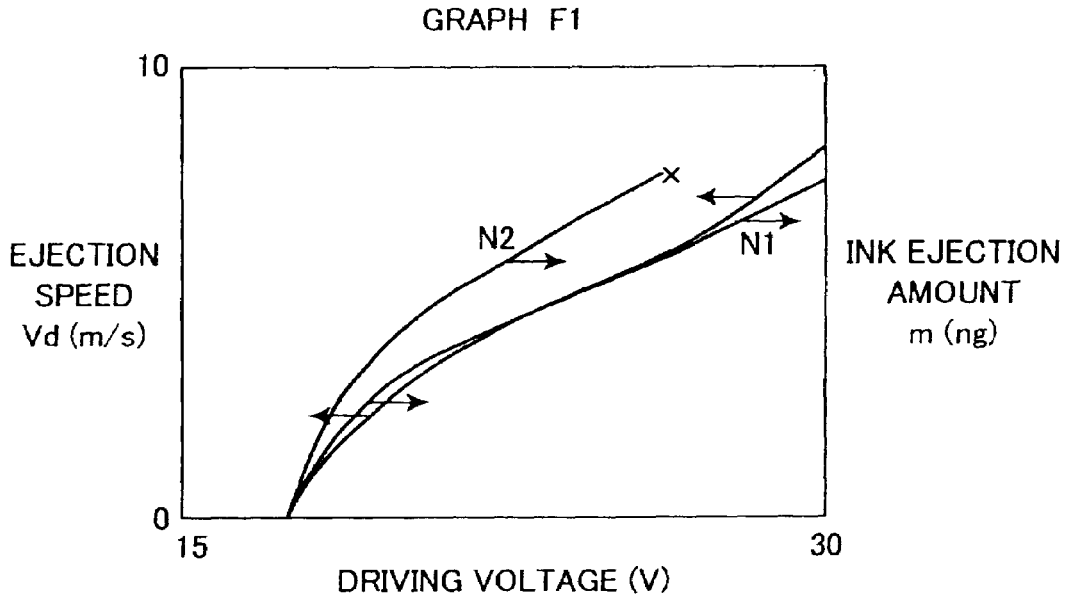
FIG.3 PRIOR ART
FIG. 3 is a graph showing relationships between a driving voltage and an ejection speed and between the driving voltage and an ejection amount.

The profile data update unit 101 stores the graph F1 shown in FIG. 3. The graph F1 is prepared in a following manner. That is, the print head 207 is driven for a driving voltage so as to form a dot on a recording sheet. Then, the measuring unit 102 picks up the dot on the recording sheet and determines a center position of the dot. Because measurement of the center position is hardly affected by external light, such as from an electric light, even the measuring unit 102 having a low resolution can precisely measure the center position. In the present embodiment, a 600 dpi CCD camera is used to obtain a photograph image at 256 tones, and the center position is determined by a well-known center measurement program. Then, the same procedure is repeated for different driving voltages. The ejection speed Vd is calculated using the above-described equation E1, and then the graph F1 is prepared. It should be noted that although in the present embodiment the graph F1 is prepared in the above-described manner, the graph F1 can be prestored in the profile data update unit 101.

The profile data update unit 101 changes the pulse data 1 for each nozzle 207*a* based on both the graph F1 and the target ink ejection amount M. Because the driving voltage is fixed to a predetermined value in the present embodiment, the driving voltage cannot be changed for each nozzle 207*a*. Therefore, in the present embodiment, the pulse data 1 is changed so as to change rising timing and falling timing of the driving pulse in the following manner.

Figure 11:
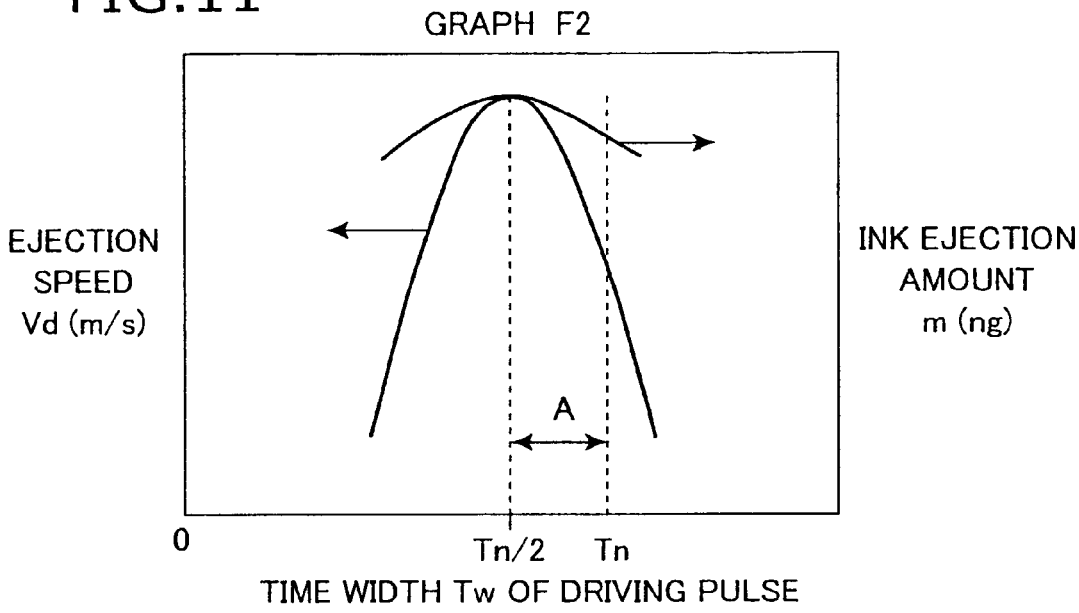
FIG. 11 is a graph showing relationships between a driving pulse time width and the ejection speed and between the driving pulse time width and the ejection amount.

FIG. 11 shows a graph F2 showing normal relationships between a time width Tw (μs) of a driving pulse and an ejection speed Vd (m/s) and between the time width Tw and the ink ejection amount m (ng). The driving voltage is a rectangular-shaped single pulse. When resonant frequency of a nozzle is Tn (18 μs in the present embodiment), it is understood from the graph F2 that the ejection speed Vd and the ink ejection amount m have a maximum value when the driving pulse has a time width Tw of Tn/2. Accordingly, when the time width Tw of the driving pulse is set to a region A between Tn/2 and Tn, the ink ejection amount m can be changed to the target amount M. It should be noted that because the resonance Tn is 18 μs and the time duration Td is 36 μs in the preset embodiment as described above, the time width Tw of the driving pulse can be in a range from 9 μs to 13.5 μs (from Tn/2 to Tn).

For example, time widths Tw of driving pulses for nozzles Nos. 1, 2, and 3 may be determined, based on the graph F2, to be 13.5 μs, 11.2 μs, 9.0 μs, respectively. Then, these values are converted into values in hexadecimal number system, that is, "07e0", "03e0", "03c0", respectively, in this example. Then, the nozzle profile data 211 is updated as shown in FIG. 17.

As described above, the time width Tw of the driving pulse for each nozzle 207*a* is determined by using the graph F2, thereby properly changing the ink ejection amount m. Because there is no need to change the driving voltage of the pulse data 212 in order to change the ejection amount m, the piezoelectric element driver 206 can have a simple and compact circuit configuration, and also have an improved practical use.

As described above, the ink ejection amount m has been changed. However, the ejection speeds Vd have not yet been changed, so differ between the nozzles 207*a*, so the impact positions y still differ. Accordingly, the impact position Y of each nozzle 207*a* is changed to a target impact position Yn next at the second stage.

At the second stage as shown in FIG. 6, first a test printing is performed for forming a dot on a recording sheet, and the measuring unit 102 measures the impact position Y of the recorded dot. The measuring unit 102 outputs data on the measured impact position Y to the profile data update unit 101. The profile data update unit 101 calculates a difference between the measured impact position Y and the target impact position Yn, then adds the difference to the corresponding y coordinate value of the nozzle profile data 211. Accordingly, the ejection position Y0 is changed, so the impact position Y is changed properly.

As described above, both the impact position Y and the ink ejection amount m for each nozzle are properly changed to a value within a predetermined region. Therefore, line scanning type ink jet recording device including an on-demand ink jet print head capable of reliably printing a high quality of image at a high speed can be provided.

Next, a profile data adjusting operation will be described. The profile data adjusting operation is for preventing interference in ejection speeds Vd and ink ejection amounts m among the nozzles 207*a*, and is performed by a profile data adjusting unit 250 shown in FIG. 4 after the above-described update operation is completed.

It should be noted that interference is avoided in a conventional multishift operation by dividing a plurality of nozzles into a plurality of groups, and generating driving pulses at different timing for each group, so that generating timings of the driving pulses will not be synchronized between the nozzles in different groups. However, the conventional multishift operation is effective only when driving pulses have a short time width. For example, the time width may be about 10 μs, which is shorter than a dot frequency of 100 μs for repeatedly recording a dot.

Also, it is difficult to perform the above-described multishift operation in the printer of the present embodiments. This is because a generating timing of a driving pulse differs among the nozzles 207*a* since the impact positions Y are changed for each nozzle 207*a* during the second stage of the above described updating operation. Therefore, the interference may cause an undesirable large effect on printing quality.

Figure 13:
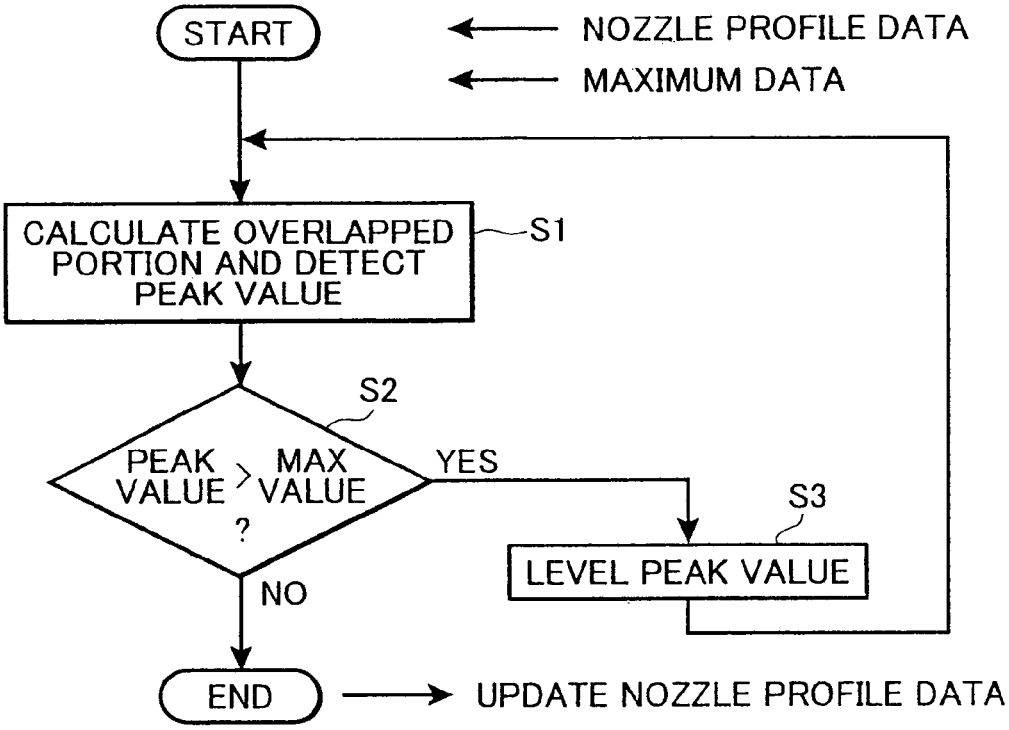
FIG. 13 is a flowchart representing a process executed by a profile data updating unit.

In order to overcome these problems, according to the present invention, the profile data adjusting unit 250 performs the profile data adjusting operation represented by the flowchart shown in FIG. 13. When the process is started, first in S1, an overlapped portion is calculated, and a peak value is detected. Specifically, registers are prepared for each bit of the pulse data 1. The registers are memory regions secured for a specific purpose. Because the pulse data 1 of the present embodiment includes 16 bits, 16 registers are prepared, that is, registers r15, r14, . . . , r0. Next, a pulse data 1 (a7, a6, a5, a4, a3, a2, a1, a0, b7, b6, b5, b4, b3, b2, b1, b0) and a y coordinate value are retrieved from the nozzle profile data 211 for a nozzle 207*a*. Then, the pulse data 1 is shifted by the y coordinate value. For example, the pulse data 1 may result in (a2, a1, a0, b7, b6, b5, b4, b3, b2, b1, b0, a7, a6, a5, a4, a3). Then, the value of the shifted pulse data 1 is added to the registers. The same process is repeatedly executed for all nozzles 207*a*, then a maximum value of the registers is determined and set as a peak value. Next in S2, it is determined whether or not the peak value is greater than a predetermined maximum value. If not (S2:NO), then the process is ended, and the updated nozzle profile data 211 is output to the nozzle data converting portion 204. On the other hand, if so (S2:YES), then in S3, the peak value is leveled in the following manner.

That is, it is detected whether or not a center of a pulse indicated by the shifted pulse data 1 is located near the peak value. If so, then the y coordinate value of the pulse data 1 is shifted in a direction away from the peak value. As a result, the number of nozzles 207*a* that has a driving pulse overlapping with the peak value is decreased, so the peak value is leveled. Then, the process is returned to S1.

In this way, the peak value at the overlapping portion will be lowered below the predetermined maximum value. As a result, the same effect as those obtained by the above-described multishift operation can be obtained. That is, generating timings of the driving pulses are leveled so as to avoid a relatively large number of driving pulses from being generated at the same time. It should be noted that the profile data adjusting process somewhat lowers the accuracy in correction of the impact position Y. However, the effects of the profile data adjusting unit 250 on the impact position Y is only 1/16 dot or 2/16 dot, which is too small to cause problems in image quality.

Next, a printer according to a second embodiment of the present invention will be described. The printer of the second embodiment is capable of overcoming the following problems in the printer of the first embodiment.

That is, as shown in FIG. 11, the ejection speed Vd greatly changes in the region A compared with the ink ejection amount m. Accordingly, when the ink ejection amount m is slightly changed at the first stage of the updating process, the ejection speed Vd changes greatly, so the impact position Y also changes greatly. Therefore, the impact position Y of an ink droplet needs to be changed by a large amount at the second stage, so the above update process is insufficient. Also, because the curve shown in the graph F2 of FIG. 11 has a reversed U shape with a maximum value in the middle rather than a simple straight line shape, desired correction may not be achieved in a simple manner.

In order to overcome these problems, the printer of the second embodiment changes the ink ejection amount m by dividing each driving pulse into a plurality of sub-pulses in the following manner.

Figure 12A:
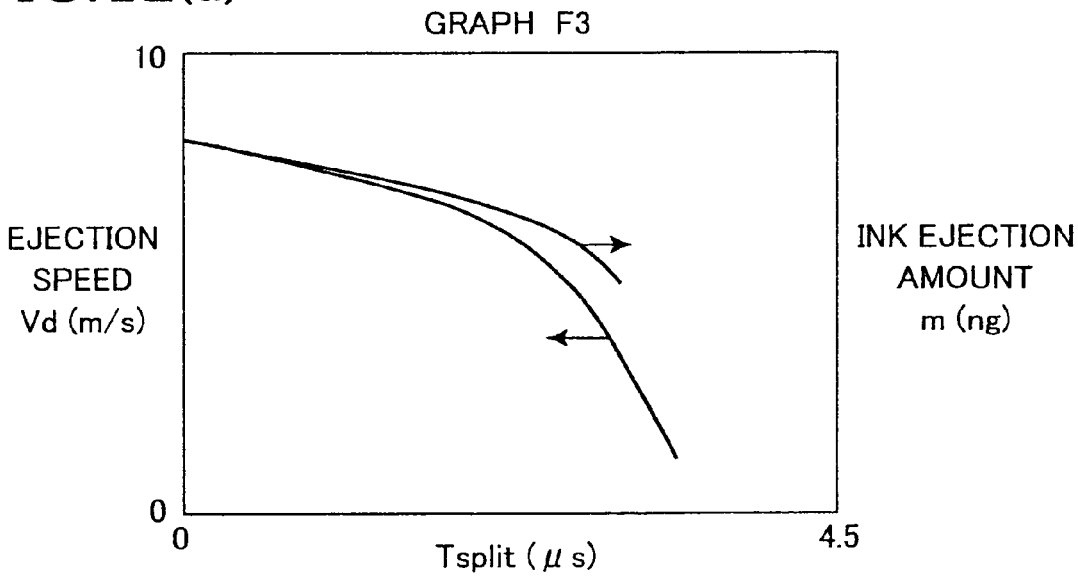
FIG. 12(*a*) is a table showing relationships between a voltage unapply time width and the ejection speed and between the voltage unapply time width and the ejection amount.
Figure 12B:
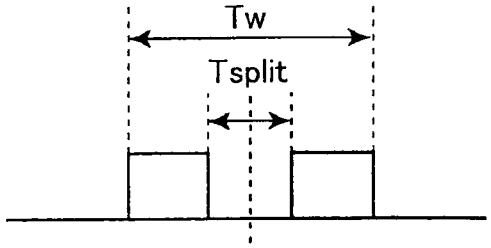

FIG. 12(*b*) shows a driving pulse divided into two sub-pulses at its center by a voltage non-application time having a time width of Tsplit (μs). FIG. 12(*a*) shows a graph F3 showing relationships between the Tsplit and an ejection speed Vd(m/s) and between the Tsplit and an ink ejection amount m (ng). In the present example, the time width Tw of the driving pulse is set to Tn/2, that is, 9 μs. The profile data update unit 101 determines the pulse data 1 based on both the target ink ejection amount M and the graph F3 which indicates the relationship between the Tsplit and the ink ejection amount m, and updates the nozzle profile data 211, in a similar manner as in the above-described first embodiment.

An example is shown in FIG. 18. It should be noted that the time width of the driving pulses for the nozzles n1, n2, n3 are set to 9.0 (μs) in the present example. Based on the graph F3 of FIG. 12, it is determined that the Tsplit for these nozzles 207*a* should be 0 μs, 2.2 μs, and 4.5 μs, respectively, in order to achieve the target ejection amount M. Accordingly, the pulse data 1 for the nozzles n1, n2, and n3 will be "03c0", "340", "02c0", respectively, in the hexadecimal number system. In this way, the nozzle profile data 211 is updated.

Subsequently, the impact position Y, that is, the ejection speed Vd, is changed in the same manner as at the second stage of the updating process described above for the first embodiment.

As shown in FIG. 12, the ejection speed Vd and the ink ejection amount m changes in the similar manner in response to change in the Tsplit. Therefore, according to the second embodiment, the ejection speed Vd needs to be changed by a smaller amount compared with the first embodiment. Accordingly, the efficiency of the update operation is as good as those using the graph F1 of FIG. 3. Moreover, because the curve shown in FIG. 12 has a simple curving shape, the correction can be easily performed.

It should be noted in the above-described example the driving pulse is divided into two sub-pulses while the time width Tw of the driving pulse is unchanged. However, the driving pulse can be divided into three or more sub-pulses. At this time, if a time resolution is insufficient, the number of the bits of the pulse data 1 can be increased.

When a driving pulse is divided into a larger number of sub-pulses, effects of a pulse duty on the ejection speed Vd and the ink ejection amount m usually becomes similar to those of the driving voltage described in the graph F1 of FIG. 3. It should be noted that the pulse duty is a ratio of voltage apply time duration to a total time duration of driving pulse. For example, when the right and the left of the graph F3 of FIG. 12 is reversed, then the appearance of the graph F3 becomes similar to the graph F11. One possible explanation for this is that the piezoelectric element driver 206 becomes incapable of responding to an input signal, thereby dropping effective voltage. When the response capability of the piezoelectric element driver 206 is sufficiently high, high frequency component of the output voltage unstabilizes the characteristics shown in FIG. 12. In this case, the characteristics can be stabilized by using a low pass filter described next.

Figure 19:
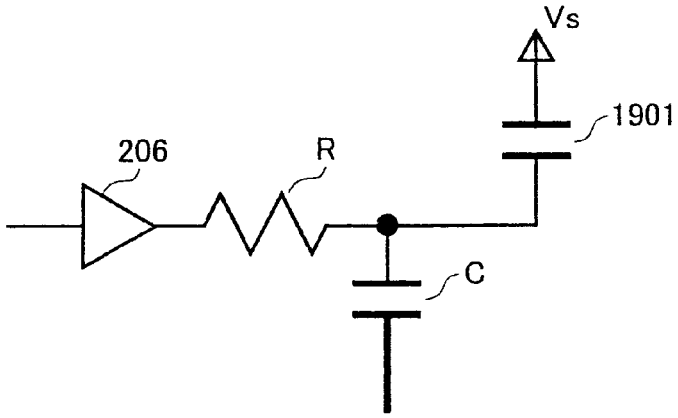
FIG. 19 is a circuit diagram showing of a smoothing circuit of a piezoelectric element of the print head.

The low pass filter is achieved by a smoothing circuit shown in FIG. 19 which is for multiple pulse driving. The capacitance 1901 represents the piezoelectric element 304 shown in FIG. 5. Conventionally, the piezoelectric element driver 206 is directly connected to the capacitance 1901, that is, the piezoelectric element 304. However, according to the present embodiment, a resistance R and a capacitance C are provided between the driver 206 and the capacitance 1901. Accordingly, although the driver 206 has a high response, the voltage applied to the capacitance 1901 can be smoothed in a suitable manner, thereby stabilizing the relationship between the pulse duty and the ink ejection amount m.

Next, a third embodiment of the present invention will be described while referring to FIGS. 11, 12, 14, 15, and 16, and 11.

In the above-described first and second embodiments, it is assumed that the print head 207 ejects an ink droplet along a normal line in a direction perpendicular to the nozzle surface 312*a*. However, an actual ink droplet is ejected in a direction slightly angled with respect to the normal line toward the y direction and/or x direction. The angle of the ink ejection with respect to the normal line differ among the nozzles 207*a*. Accordingly, impact positions shift from a target impact position with respect to the y and x directions because of the slight difference between the actual ink ejection direction and the direction in which the normal line extends.

The printer of the third embodiment corrects error on impact position caused by such a direction difference for each nozzle 207*a*.

Figure 14:
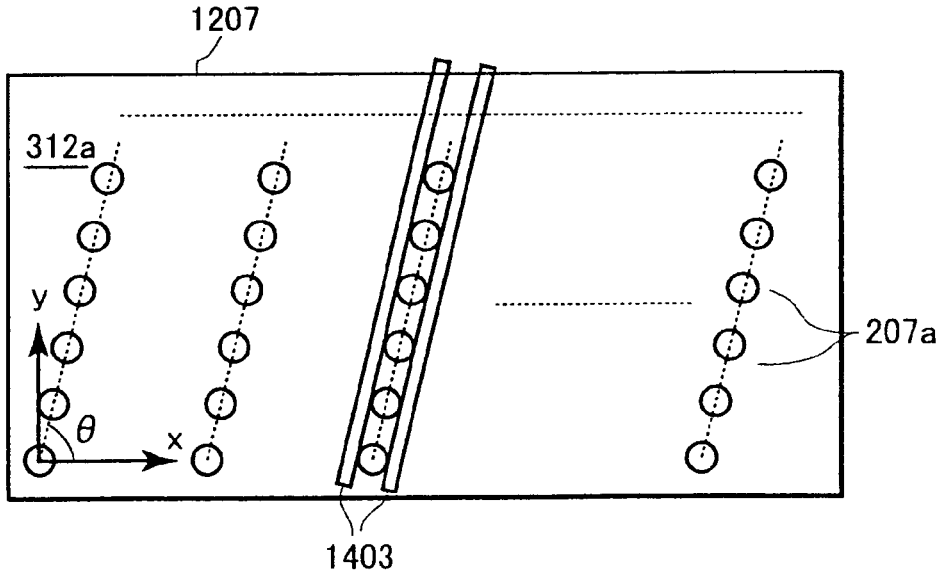
FIG. 14 is a plan view showing a configuration of a print head according to a second embodiment.
Figure 15:
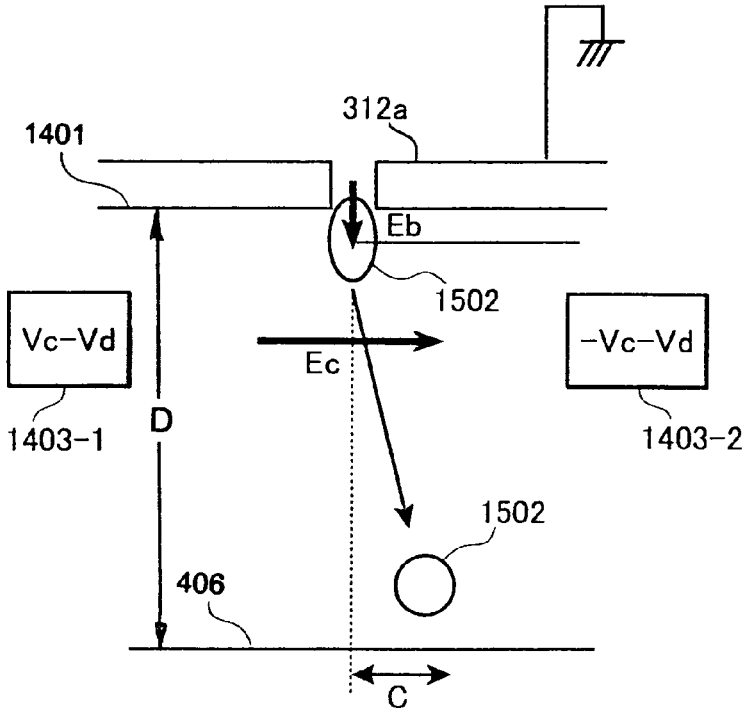
FIG. 15 is a side view showing the print head of FIG. 14 and a recording sheet.

The printer of the third embodiment includes a print head 1207 shown in FIGS. 14 and 15. The print head 1207 is similar to the print head 207 of the first and second embodiments except that deflection electrodes 1403 are provided between a nozzle surface 312*a* of the print head 1207 and a recording sheet 406. The deflection electrodes 1403 are provided for all of the first nozzle line through the tenth nozzle line (only two deflection electrodes 1403 are shown in FIG. 14 for the third nozzle line).

The deflection electrodes 1403 includes a first electrode 1403-1 and a second electrode 1403-2. The first electrode 1403-1 is applied with a deflection voltage Vc and a deflection voltage Vd. The deflection voltages Vc and Vd have a predetermined voltage value greater than 0 v. The second electrode 1403-2 is applied with a deflection voltage -Vc which has an opposite polarity of the deflection voltage Vc applied to the first deflection electrode 1403-1, and also with a deflection voltage Vd which has the same polarity with the deflection voltage Vd applied to the first deflection electrode 1403-1. Accordingly, a deflection electric field Ec is generated between the deflection electrodes 1403-1 and 1403-2. The deflection electric fields Ec corresponds to a deflection voltage difference 2 Vc between the deflection electrodes 1403-1 and 1403-2. Also, because the nozzle plate 1401 is formed from a conductive material and is grounded, a deflection electric field element Eb corresponding to the deflection difference Vd is generated near the nozzle 207*a*.

When an ink droplet 1502 is ejected, the ink droplet 1502 is charged in the positive polarity by a charging amount q because of the electric field Eb. Thus charged ink droplet 1502 deflects rightward in FIG. 15 because of the deflection electric field Ec. Accordingly, an impact position of the ink droplet 1502 is shifted rightward.

It should be noted that in FIG. 14, an angle θ of the angle of the nozzle lines with respect to the x direction is set to 83 degrees in the present embodiment. Therefore, the difference between the x direction and the direction of the deflection electric field element Ec is so small that these directions can be regarded as the same direction. For this reason, the direction of the deflection electric field element Ec is regarded as the x direction in the following description.

Although there have been proposed a various different techniques to control deflection of ejected ink droplet using electric fields in various manners, it is assumed that a uniform deflection electric field element Ec is generated between the nozzle 207*a* and the recording sheet 406 in the present embodiment in order to simplify the explanation. Also, the deflection amount of the ink droplet 1502 will be calculated without taking the influence caused by the electric field element Eb into consideration.

It is assumed that the nozzle 207*a* is located at a position having an x coordinate value of zero. When the ink droplet 1502 is ejected from the nozzle 207*a* exactly along the normal line, then an x coordinate value of an impact position (hereinafter referred to as "impact position X") on the recording sheet 406 is calculated using a following equation:

$$x = x0 + \frac{Ec}{2} \cdot \frac{q}{m} \cdot \left(\frac{D}{Vd}\right)^2 \tag{E2}$$

wherein x is an x coordinate value of the impact position of the ink droplet 1502 on the recording sheet 406;

x0 is a position on the recording sheet 406 which is located directly beneath the nozzle 207*a* at the exact time when the ink droplet 1502 is ejected;

Ec is the magnitude of the deflection electric field element Ec;

q is the charging amount of the ink droplet 1502;

m is an ink amount of the ink droplet 1502;

D is a distance between the nozzle surface 1401 and the recording sheet 406; and Vd is an ejection speed of the ink droplet 1502.

According to the above-described equation, it can be understood that when the ink amount m is fixed, then the charging amount q is fixed also. Therefore, when the ejection speed Vd is changed while the ejection amount m is unchanged, then the impact position X will change. The printer of the present embodiment controls the impact position X by utilizing the above equation E2. Details will be described next.

Figure 16:
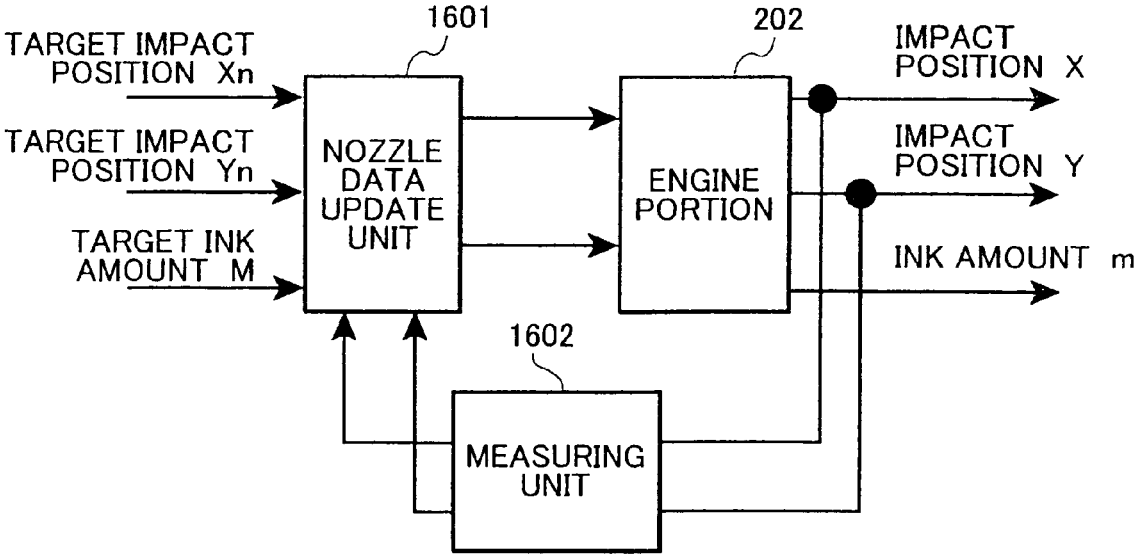
FIG. 16 is an explanatory block diagram showing a control method of the print head of FIG. 14.

The computer portion 201 of the printer system of the present embodiment is further provided with a profile data update unit 1601 shown in FIG. 16. The profile data update unit 1601 updates the y coordinate value and pulse data 1 of the nozzle profile data 211 based on target impact positions Xn and Yn and a target ejection amount M, thereby updating an updated nozzle profile data 211. Then, the bitmap data 209 is converted into the driving data 212 based on the updated nozzle profile data 211. In this way, ink ejection can be ejected onto the target impact positions Xn, Yn with the target ink amount M by all the nozzles 207*a*.

The update process performed by the profile data update unit 1601 includes a first stage, a second stage, and a third stage. At the first stage, an ink ejection amount m is adjusted to a target ejection amount M for each nozzle 207*a*. At the second stage, the impact position X in the x direction is adjusted. At the third stage, the impact position Y in the y direction is adjusted.

First, the first stage will be described. The profile data update unit 1601 stores the graph F3 shown in FIG. 12 indicating the relationship between a Tsplit (μs) and an ink ejection amount m(ng). The profile data update unit 1601 determines pulse data 1 based on both the graph F3 and a target ejection amount M, and then updates the nozzle profile data 211. The updating method of the pulse data 1 is the same as those explained in the second embodiment while referring to FIG. 18, so the explanation will be omitted here.

Next, at the second stage, test printing is performed. Then, the measuring unit 1602 measures an actual impact position X, and the measured value is input to the profile data update unit 1601. The measuring unit 1602 is similar to the measuring unit 102 shown in FIG. 6. However, the measuring unit 1602 can measure both the impact positions X and Y. The profile data update unit 1601 calculates a difference between the actual impact position X and the target impact position Xn. Then, based on the calculated difference, the profile data update unit 1601 calculates a target ejection speed Vd using the equation E2. The profile data update unit 1601 changes the time width Tw of the driving pulse while referring to the graph F2 shown in FIG. 11, so that the calculated target ejection speed Vd is achieved. As described above, the ejection amount m changes only slightly in response to the change in the ejection speed Vd as indicated by the graph F2 showing the relationship between time width Tw and the ejection speed Vd. Therefore, slight change in the time width Tw hardly changes the ejection amount m. In this way, the ejection speed Vd is changed without changing the ejection amount m.

Next at the third stage, the test printing is further performed. Then, the measuring unit 1602 measures the actual impact position Y, and inputs the measured impact position Y to the profile data update unit 1601. The profile data update unit 1601 calculates a difference between the measured impact position Y and the target impact position Yn, and updates the y coordinate value of the nozzle profile data 211 based on the calculated difference. Then, the ejection position Y0 is changed by using the equation E1, so the impact position Y is changed accordingly.

As described above, according to the third embodiment, the impact positions X and Y and the ink ejection amount m can be set to values within predetermined regions for each nozzle 207*a*.

Figure 20:
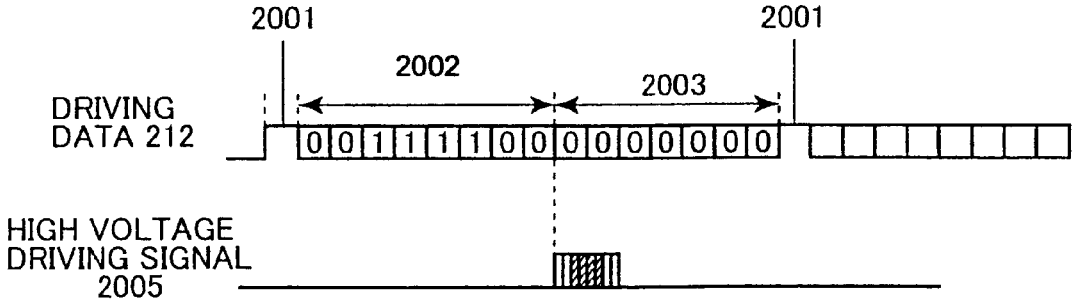
FIG. 20 is an explanatory diagram showing an operation of a data speed converter.
Figure 21:
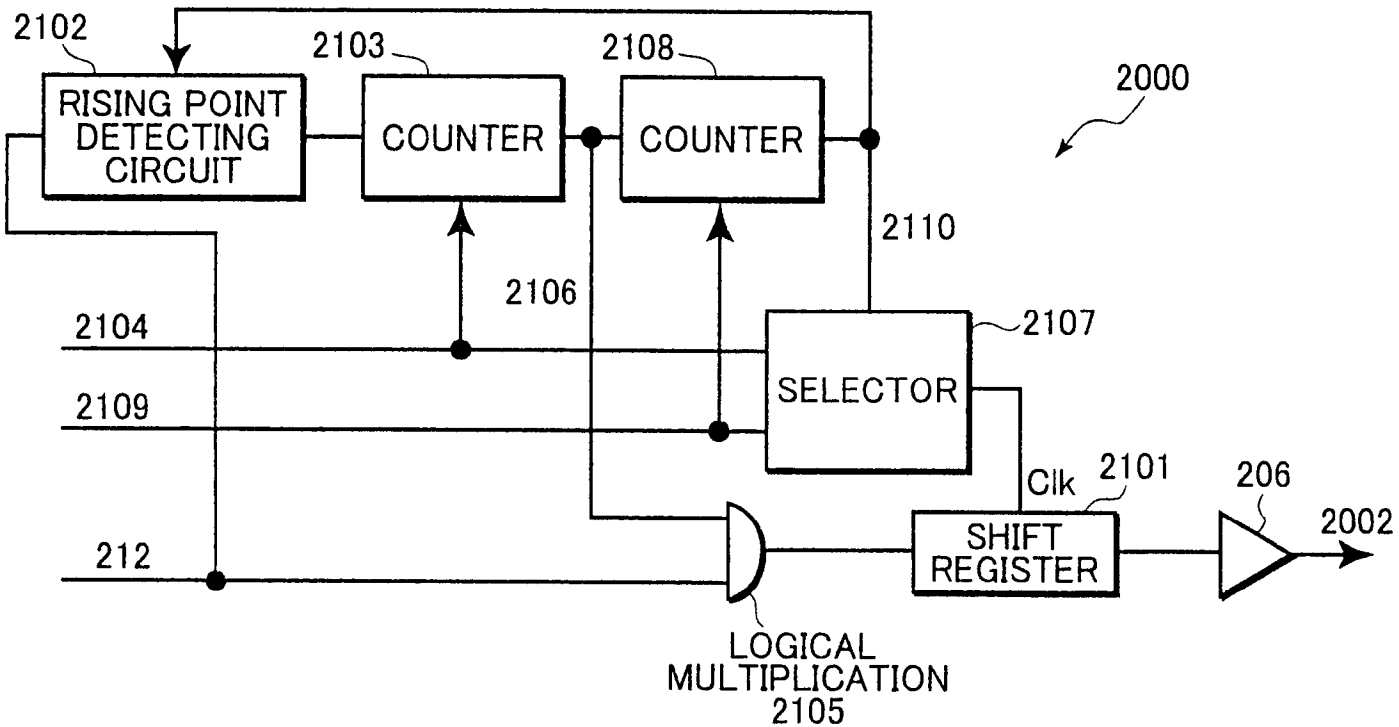
FIG. 21 is a block diagram of circuit configuration of the data speed converter.

Next, a printer according to a fourth embodiment of the present invention will be described while referring to FIGS. 20 and 21. As shown in FIG. 21, a controller 205 of the printer of the present embodiment further includes a data speed converting unit 2000.

According to the above-described embodiments, the time resolution is set to 1/16 of the time duration Td(μs) that is required for recording a single dot. Therefore, in a printer where the sheet feed speed Vp, that is, the printing speed, is changed, the time duration Td is also changed, thereby changing the pulse waveform. The pulse waveform is determined in accordance with the nozzle characteristics described above, and is not directly related to the printing speed Vp. For this reason, it is undesirable for the pulse waveform to change in association with the printing speed Vp. Also, when the driving pulse time width Tw is small relative to the time duration Td(μs), the time resolution at the time for setting the pulse waveform is undesirably rough.

In order to overcome the above-problems, according to the printer of the fourth embodiment, the time resolution of the pulse data 1 is set to a predetermined value, while the time resolution for the y coordinate value is set to 1/16 of the time duration Td in the manner as described for the above embodiments. Therefore, even if the time resolution for the y coordinate value is changed due to change in printing speed, the time resolution of the pulse data 1 will not change. Details will be described later.

As shown in FIG. 21, the data speed converting unit 2000 includes a shift register 2101, a rising point detecting circuit 2102, a counter 2103, a driving data clock 2104, a logical multiplication 2105, a selector 2107, and a counter 2108. The counters 2103 and 2108 are both self-stop type counters. The shift register 2101 is formed from eight D-flip-flops. The selector 2107 selectively receives a driving data clock 2104 and a pulse data clock 2109. The pulse data clock 2109 is used when the driving data 212 is stored into the shift register 2101. The driving data clock 2104 is used when the driving data 212 stored in the shift register 2101 is output to the piezoelectric element driver 206. The driving data clock 2104 changes in accordance with the printing speed Vp, and is in synchronization with the driving data 212. The pulse data clock 2109 is predetermined and does not change regardless of the change in the printing speed Vp. The pulse data clock 2109 has normally a higher frequency than the driving data clock 2104.

A driving data 212 is input to the circuit 2102. When the circuit 2102 detects a rising point of the received driving data 212, the counter 2103 starts counting the driving data clock 2104 and also outputs an ON-signal 2106 indicating that the counter 2103 is driving. The ON-signal 2106 is output to the logical multiplication 2105. Having counted eight clocks, the counter 2103 stops driving. The driving data 212 is also input to the logical multiplication 2105. When the logical multiplication 2105 receives the ON-signal 2106, the logical multiplication 2105 outputs the driving data 212 to the shift register 2101. The driving data clock 2104 is also input to a clock of the shift register 2101 via the selector 2107, so eight bits of the driving data 212 is stored into the clock of the shift register 2101 one bit at a time. When an end of the ON-signal 2106 from the counter 2103 is detected, the counter 2108 starts. The counter 2108 counts a predetermined pulse data clock 2109, and stops counting when the counter 2108 has counted eight clocks. When an output signal from the counter 2108 is an ON-signal indicating that the counter 2108 is driving, then the selector 2107 switches to receive the pulse data clock 2109. Also, the shift register 2101 outputs the eight bits of the driving data 212 to the piezoelectric element driver 206 in synchronization with the pulse data clock 2109.

Next, operations of the data speed converting unit 2000 will be described while referring to FIG. 20. As shown in FIG. 20, the driving data 212 includes a single start bit 2001 followed by eight pulse bits 2002. In the example shown in FIG. 20, the eight pulse bits 2002 have a value of "3c" in the hexadecimal number system representing "00111100". The eight pulse bits 2002 are followed by seven zero bits 2003 each having a value of "0". The same pattern is repeated at 16 bits cycle. The piezoelectric element driver 206 starts outputting a high voltage driving signal 2005 directly after the shift register 2101 has outputted the eight pulse bits in synchronization with the pulse data clock 2109.

According to the present embodiment, even when the driving data clock 2104 changes as a result of the change in the print speed Vd, the pulse waveforms is maintained at a constant form. Therefore, the ink ejection characteristics will be maintained unchanged. Also, the time resolution for setting the pulse waveform is not related to the time duration Td. Usually, the time resolution is set small. However, even when the driving pulse time width Tw is small compared with the time duration Td, highly precise modulation can be performed.

As described above, according to the present invention, a dot-on-demand type line scanning ink jet image forming device includes a print head capable of controlling both an ink ejection amount and an impact position of an ink droplet on a recording medium for each of a plurality of nozzles. Accordingly, a high quality image can be formed. Also, nozzle profile data is updated based on either a target ink ejection amount and target impact position or measurement value of an actually ejected ink droplet. Therefore, undesirable effects of unevenness among the nozzles on the printing quality can be reliably prevented. Further, because a generating timing of a driving pulse is controlled, change in a size and a shape of an ink droplet and an impact position due to interference can be also prevented.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. The ink jet recording device comprising:

a head formed with a plurality of nozzles;

a converting unit that converts recording data into driving data that defines driving pulses of corresponding ones of the plurality of nozzles;

a feed unit that feeds a recording medium in a first direction;

an ejection element provided to each one of the plurality of nozzles for ejecting an ink droplet from the corresponding nozzle onto the recording medium in response to the driving data while the feed unit is feeding the recording medium in the first direction; and a memory that stores nozzle profile data including waveform data and timing data for each of the plurality of nozzles, the waveform data and the timing data indicating a waveform and a generating timing, respectively, of the driving data for each one of the plurality of nozzles;

wherein the converting unit converts the recording data into the driving data based on the nozzle profile data, the driving data is a sequence of pulse data, each pulse data corresponding to one of the plurality of nozzles;

a designating unit that designates a target ink amount of the ink droplet and a target impact position on the recording medium on which the ink droplet impacts with respect to both the first direction and a second direction substantially perpendicular to the first direction;

a measuring unit that includes:

a first measuring unit that measures a first distance between the target impact position and an actual impact position on the recording medium where the ink droplet has impacted with respect to the first direction; and a second measuring unit that measures a second distance between the target impact position and the actual impact position with respect to the second direction; and an updating unit that updates the nozzle profile data based on the target impact position, the first distance, and the second distance.

2. The ink jet recording device according to claim 1, wherein the updating unit includes a first unit and a second unit, the first unit updating the waveform data of the nozzle profile data so as to change the ejected ink amount of the ink droplet, the second unit updating the timing data of the nozzle profile data so as to control the actual impact position with respect to the first direction.

3. The ink jet recording device according to claim 2, wherein each of the ejection elements ejects a single ink droplet from a corresponding one of the nozzles in response to a corresponding one of the driving pulses, and each of the driving pulses includes a plurality of sub pulses which are determined by the waveform data, wherein adjacent two of the plurality of sub pulses are divided by a split time.

4. The ink jet recording device according to claim 3, wherein each of the driving pulses has a time width which is determined by the waveform data of the nozzle profile data, and the first unit updates the waveform data so as to change at least one of the time width of each of the driving pulses, the split time of each of the driving pulses, and a pulse duty of the driving pulses.

5. The ink jet recording device according to claim 4, further comprising a smoothing unit provided to the driving element, wherein the driving element includes a piezoelectric element and an element driver that controls the piezoelectric element, the element driver outputting a driving signal to the piezoelectric element in response to the driving data, wherein the smoothing unit smoothes the driving signal output from the element driver.

6. The ink jet recording device according to claim 1, further comprising a deflection electric field generating unit and a charging electric field, generating unit, the deflection electric field generating a deflection electric field in a space defined between the recording medium and the head, the deflection electric field having field element in the second direction and a third direction in which the ink droplet is ejected, the charging electric field generating unit generating a charging electric field in the plurality of nozzles, the charging electric field having a field element in the third direction.

7. The ink jet recording device according to claim 1, wherein the updating unit includes:

a first unit that changes the waveform data, wherein each of the driving pulses includes a plurality of sub pulses, and adjacent two of the sub pulses are separated by a split time, and wherein the first unit changes the waveform data so as to change one of the split time and a pulse duty of the plurality of the sub pulses, thereby changing the actual ink amount for each of the plurality of nozzles;

a second unit that changes the waveform data after the first unit has changed the waveform data, wherein each of the driving pulses has a time width, and the second unit changes the waveform data so as to change the time width, thereby controlling the actual impact position with respect to both the first direction and the second direction, and a third unit that changes the timing data after the second unit has changed the waveform data so as to control the actual impact position with respect to the first direction for each of the plurality of nozzles.

8. The ink jet recording device according to claim 7, further comprising a smoothing unit provided to the driving element, wherein the driving element includes a piezoelectric element and an element driver that controls the piezoelectric element, the element driver outputting a driving signal to the piezoelectric element in response to the driving data, wherein the smoothing unit smoothes the driving signal output from the element driver.

* * * * *